US010058916B2

(12) United States Patent
Bishop et al.

(10) Patent No.: US 10,058,916 B2
(45) Date of Patent: Aug. 28, 2018

(54) ALUMINUM ALLOY POWDER METAL WITH HIGH THERMAL CONDUCTIVITY

(71) Applicant: GKN Sinter Metals, LLC, Auburn Hills, MI (US)

(72) Inventors: Donald Paul Bishop, Stillwater Lake (CA); Richard L. Hexemer, Jr., Granite Falls, NC (US); Ian W. Donaldson, Jefferson, MA (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 601 days.

(21) Appl. No.: 13/917,072

(22) Filed: Jun. 13, 2013

(65) Prior Publication Data

US 2013/0333870 A1 Dec. 19, 2013

Related U.S. Application Data

(63) Continuation-in-part of application No. PCT/US2011/064421, filed on Dec. 12, 2011.

(60) Provisional application No. 61/422,464, filed on Dec. 13, 2010.

(51) Int. Cl.

| | |
|---|---|
| ***B22F 1/00*** | (2006.01) |
| ***C22C 1/04*** | (2006.01) |
| ***C22C 32/00*** | (2006.01) |

(52) U.S. Cl.

CPC ..... *B22F 1/0003* (2013.01); *C22C 1/0416* (2013.01); *C22C 32/0047* (2013.01)

(58) Field of Classification Search

CPC ..... C22C 1/0416

See application file for complete search history.

(56) References Cited

U.S. PATENT DOCUMENTS

| | | | |
|---|---|---|---|
| 5,292,358 | A | 3/1994 | Miura et al. |
| 5,522,950 | A | 6/1996 | Bartges et al. |
| 5,902,943 | A | 5/1999 | Schaffer et al. |
| 2005/0036899 | A1 | 2/2005 | Lindenau et al. |
| 2009/0252637 | A1 | 10/2009 | Hurley et al. |
| 2010/0180989 | A1 | 7/2010 | Ahmad et al. |

FOREIGN PATENT DOCUMENTS

| | | | |
|---|---|---|---|
| CA | 2613177 | A1 | 1/2007 |
| CN | 1617940 | A | 5/2005 |
| CN | 1628008 | A | 6/2005 |
| CN | 1643171 | A | 7/2005 |
| CN | 101435030 | A | 5/2009 |
| EP | 0436952 | A1 | 7/1991 |
| EP | 1344593 | A2 | 9/2003 |
| JP | S5881946 | A | 5/1983 |
| JP | S62-235455 | A | 10/1987 |
| JP | H0421735 | A | 1/1992 |
| JP | H07278713 | A | 10/1995 |
| JP | H07278714 | A | 10/1995 |
| JP | H11504388 | A | 4/1999 |
| JP | 2000192185 | A | 7/2000 |
| JP | 2003007895 | A | 1/2003 |
| JP | 2006108317 | A | 4/2006 |
| JP | 2009021530 | A | 1/2009 |
| JP | 2009206191 | A | 9/2009 |
| JP | 2010077475 | A | 4/2010 |
| WO | 2010042498 | A1 | 4/2010 |

OTHER PUBLICATIONS

Z. Y. Liu, T. B. Sercombe and G. B. Schaffer, Metal injection moulding of aluminium alloy 6061 with tin, Powder Metallurgy 2008 vol. 51 No. 1, pp. 78-83.*

Graham Schaffer, High strength, lightweight aluminium alloy by metal injection moulding, Jan. 29, 2009, PIM International http://www.pim-international.com/high-strength-lightweight-aluminium-alloy-by-metal-injection-moulding/.*

Randall M. German, "Powder Injection Molding," ASM Handbook, vol. 7 (1998), pp. 355-364.*

Canadian Intellectual Property Office, Office Action, Application No. 2,819,255, dated Jul. 3, 2015, 5 pages.

Japan Patent Office, Notification of Reasons for Refusal, Application No. 2013-543408, dated Oct. 13, 2015, 14 pages.

Canadian Intellectual Property Office, Office Action, Application No. 2,819,255, dated Apr. 29, 2014, 4 pages.

Macaskill, et al., Effects of Magnesium, Tin and Nitrogen on the Sintering Response of Aluminum Powder, Journal of Materials Processing Technology, Nov. 19, 2010, 210(15):2252-2260.

Tan, et al., Performance of Powder Injection Molding (PIM) Heat Sink, The Ninth Intersociety Conference on Thermal and Thermomechanical Phenomena in Electronic Systems, ITHERM '04, 2004, 1:451-454.

European Patent Office, Extended European Search Report, Application No. 11848714.9, dated Jun. 12, 2014, 8 pages.

The State Intellectual Property Office of the People's Republic of China, First Office Action and Search Report, Application No. 201180059715.9, dated Aug. 5, 2014, 25 pages.

PCT International Search Report and Written Opinion, PCT/US2011/064421, dated May 2, 2012, 9 pages.

Landolt-Bornstein Substance / Property Index, Al—Mg—Sn (Aluminium, Magnesium, Tin), http://lb.chemie.uni-hamburg.de/static/ES/2_Al_Al-Mg.php?content=ES/Al/Al-Mg-Sn, Printed Mar. 28, 2012, 1 page.

Canadian Intellectual Property Office, Examination Report, Application No. 2,819,255, dated Feb. 19, 2016.

The State Intellectual Property Office of the People's Republic of China, Second Office Action, Application No. 201180059715.9, dated Jan. 23, 2015.

The State Intellectual Property Office of the People's Republic of China, Third Office Action, Application No. 201180059715.9, dated Jul. 15, 2015.

(Continued)

*Primary Examiner* — Christopher Kessler

(74) *Attorney, Agent, or Firm* — Quarles & Brady LLP

(57) ABSTRACT

An aluminum alloy powder metal is disclosed. A sintered part made from the aluminum alloy powder has a thermal conductivity comparable to or exceeding parts made from wrought aluminum materials.

13 Claims, 5 Drawing Sheets

(56) References Cited

OTHER PUBLICATIONS

European Patent Office, Communication, Application No. 11848714.9, dated Apr. 21, 2016.
Japan Patent Office, Notification of Reason for Refusal, Application No. 2013-543408, dated Mar. 29, 2016.
Japanese Patent Office, Notification of Reason for Refusal (with English translation) for related Japanese Application No. 2016-121530, dated Jun. 27, 2017, 5 pages.

* cited by examiner

ALUMINUM ALLOY POWDER METAL WITH HIGH THERMAL CONDUCTIVITY

CROSS-REFERENCE TO RELATED APPLICATION

This application is a continuation in part patent application of PCT patent application entitled "Aluminum Alloy Powder Metal with High Thermal Conductivity" having PCT application No. PCT/US2011/064421 filed Dec. 12, 2011 and further claims the benefit of U.S. provisional patent application entitled "Aluminum Alloy Powder Metal with High Thermal Conductivity" having Ser. No. 61/422,464 filed Dec. 13, 2010. Those applications are incorporated by reference as if set forth in their entirety herein.

STATEMENT OF FEDERALLY SPONSORED RESEARCH OR DEVELOPMENT

Not applicable.

BACKGROUND OF THE INVENTION

This invention relates to powder metals and parts made therefrom. In particular, this invention relates to aluminum alloy powder metals and powder metal parts made from these powder metals.

In many applications, the thermal conductivity of the material used to make a part is an important design consideration. For certain parts, such as heat sinks, the rate at which heat is transferred through the part determines the effectiveness of the part.

Conventionally, parts made from powder metal have lower thermal conductivities than wrought parts having the same or a very similar chemical composition. This is unfortunate as powder metallurgy is otherwise well-suited for making parts with fine features in large volumes such as heat sinks.

Hence, a need exists for a powder metal formulation having a thermal conductivity that, in a sintered part, is as good or better than the thermal conductivity of a part made from a wrought material.

SUMMARY OF THE INVENTION

An aluminum alloy powder metal is disclosed. The aluminum alloy powder metal includes a nominally pure aluminum material with magnesium and tin additions. A thermal conductivity at a given temperature of a sintered part made from the aluminum alloy powder metal exceeds a thermal conductivity at the given temperature of a wrought part made from a 6061 aluminum alloy over a temperature range of at least 280° K to 360° K.

The magnesium addition may be made as an admixed powder and the tin addition may be made as an elemental powder or pre-alloyed with the aluminum material (pre-alloying may occur by, for example, gas atomization of a melt containing aluminum and tin). In one preferred form, the magnesium addition may be approximately 1.0 weight percent of the aluminum alloy powder metal and the tin addition may be approximately 1.0 weight percent of the aluminum alloy powder metal; although systems including 1.5 weight percent magnesium and 1.5 weight percent tin are also workable and data for that system is also detailed below. In other forms, the magnesium may be in a range of 0.2 to 3.5 wt % and the tin may be in a range of 0.2 to 2.5 wt %.

The aluminum alloy powder metal could include one or more other additions as well. The aluminum alloy powder metal may include a zirconium addition. The zirconium addition may be in a range of 0.1 weight percent to 3.0 weight percent, and in one form, approximately 0.2 weight percent. The aluminum alloy powder metal may include a copper addition. The copper addition may be added as part of a master alloy or as an elemental powder. The aluminum alloy powder metal may further include a ceramic addition which may be up to 15 volume percent of the aluminum alloy powder metal. The ceramic addition(s) may include SiC and/or AlN.

Transitional element(s), such as zirconium, may be homogenously dispersed throughout the aluminum material by, for example, gas atomizing the transitional element(s) in the aluminum material. The transitional element(s) that could be added to the aluminum alloy powder metal may include, but are not limited to, zirconium, titanium, iron, nickel, and manganese, among others.

A sintered powder metal part may be made from the aluminum alloy powder metal described above. Because of the exceptional thermal conductivity properties of the sintered powder metal part, the sintered powder metal part may be a heat sink or another part in which the thermal conductivity of the part can be utilized.

In another form, an aluminum alloy powder metal is disclosed having magnesium in a range of 0.2 to 3.5 weight percent, tin in a range of 0.2 to 2.5 weight percent, and zirconium in a range of 0.1 to 3.0 weight percent, with the remainder of the aluminum alloy powder metal being a nominally pure aluminum.

This aluminum alloy powder metal may further include copper in a range of 0 to 3.0 wt % and/or a ceramic additive in a range of 0 to 15 vol %. Such an addition may be made to improve strength or wear resistance, and reduce the Coefficient of Thermal Expansion (CTE) (for ceramic additions only).

A thermal conductivity at a given temperature of a sintered part made from the aluminum alloy powder metal may exceed a thermal conductivity at the given temperature of a wrought part made from a 6061 aluminum alloy over a temperature range of at least 280° K to 360° K.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Figure 1:
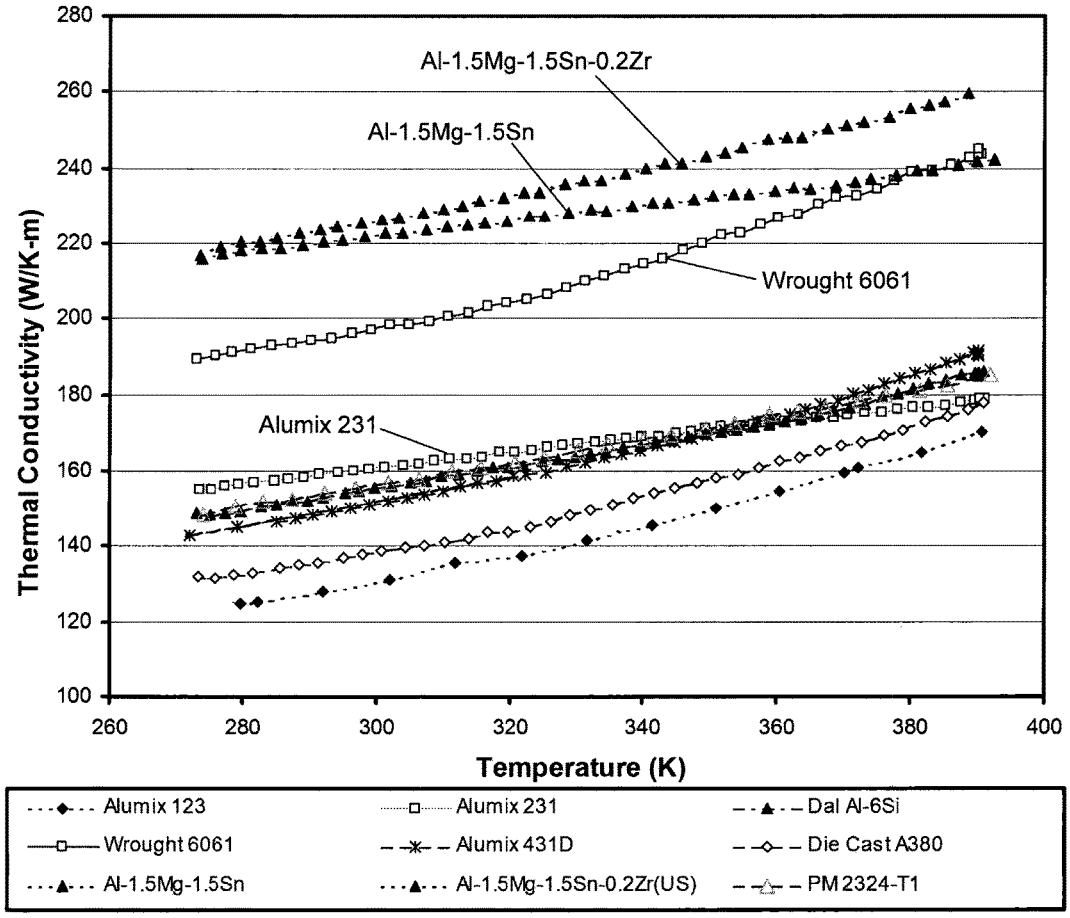
FIG. 1 is a graph comparing the thermal conductivity of parts made from various materials over a range of temperatures.

An aluminum alloy powder metal with relatively high thermal conductivities when sintered is disclosed. The aluminum alloy may include one or more of magnesium (admixed), copper (either added as part of a master alloy or as an elemental powder), and tin (added as an elemental powder and/or prealloyed with the aluminum). The aluminum alloy powder metal may further include a transitional element such as zirconium alloyed in a range of preferably 0.1 to 3.0 weight percent, although it is believed that this range include up to 6.0 weight percent zirconium. The presence of zirconium increases the recrystallization resistance.

In some forms, the composition of the aluminum alloy powder metal may have be nominally pure aluminum with one or more of the following ranges for alloying elements: 0.2 to 3.5 weight percent magnesium, 0.2 to 2.5 weight percent tin, and 0.1 to 3.0 weight percent zirconium. Optionally, 0 to 3.0 weight percent copper may be included and/or 0 to 15 volume percent ceramic additions, such as SiC and/or AlN, may be included.

Conventionally, when alloying elements are added to a powder blend, these alloying elements are added either as an elemental powder (i.e., a pure powder nominally containing only the alloying element) or as a master alloy containing a large amount of both the base material, which in this case is aluminum, and the alloying element. When a master alloy is used, to obtain the desired amount of the alloying element in the final part, the master alloy will then be "cut" with an elemental powder of the base material.

In contrast, some of the alloying elements in the aluminum powder metal may be doped into the powder metal by air or gas atomizing an aluminum-alloying element melt containing the desired final composition of the alloying element or elements. Air atomizing the powder can become problematic at higher alloying element concentrations and so it may not be possible to atomize doped powders having high weight percentages of the alloying elements (believed at this time to exceed 6 weight percent for transition elements).

Depending on the alloying element, the doping or prealloying of the alloying element can dictate the final morphology of the microstructure. For example, the addition of transitional elements in aluminum can result in the formation of intermetallics that strengthen the alloy and that remain stable over a range of temperatures and improve sinterability. If the transitional elements were added as an elemental powder or as part of a master alloy, then the intermetallic phase would be formed preferentially along the grain boundaries and would be coarse in size since relatively slow diffusion kinetics and chemical solubility prevent transitional elements from being uniformly distributed within the sintered microstructure. Under those conditions, the intermetallic phase imparts only limited improvement in the properties of the final part. By doping transitional element(s) in the aluminum powder, rather than adding transitional element(s) in the form of an elemental powder or as part of a master alloy, the transitional element(s) are more evenly and homogeneously dispersed throughout the entire powder metal. Thus, the final morphology of the transitional element-doped part will have transitional element(s) placed throughout the grains of the aluminum and the intermetallics will not be relegated or restricted to placement primarily along the grain boundaries at which they are of only limited effectiveness.

Turning now to FIG. 1, the thermal conductivities of various materials are illustrated over a temperature range of 280 K to 390 K. The thermal conductivities of nine different materials are compared to one another including seven known materials Alumix 123, Alumix 231, Dal Al-6Si, a wrought 6061 aluminum alloy, Alumix 431D, die cast A380, and PM 2324-T1, and, most notably, two new materials including the new Al-1.5Mg-1.5Sn powder metal and the new Al-1.5Mg-1.5Sn-0.2Zr powder metal. In the case of the powder metal materials, the samples were compacted and sintered before testing, whereas the wrought 6061 and die cast A380 were provided in fully dense form.

It can be seen from the chart that, other than the new powder metal materials (i.e., the Al-1.5Mg-1.5Sn and the Al-1.5Mg-1.5Sn-0.2Zr), that the material with the greatest thermal conductivity is the wrought 6061 aluminum, which is a general purpose aluminum material. The thermal conductivity of the wrought 6061 material ranges from approximately 190 W/m-K at 280 K to approximately 245 W/m-K at 390 K. All of the other sample materials have significantly lower thermal conductivities over this range, most less than 160 W/m-K at 280 K to less than 195 W/m-K at 390 K. Over most of the temperature range, the powder metal materials have thermal conductivities which are approximately 30 K less than the wrought 6061 aluminum.

Notably, however, the samples made from the new Al-1.5Mg-1.5Sn and the Al-1.5Mg-1.5Sn-0.2Zr powder metals have exceptional thermal conductivities over this temperature range. This improved thermal conductivity may be in part because the Al-1.5Mg-1.5Sn and the Al-1.5Mg-1.5Sn-0.2Zr powder metals exhibit considerable densification and there is minimal nitridation of the aluminum powder.

Both the Al-1.5Mg-1.5Sn and the Al-1.5Mg-1.5Sn-0.2Zr powder metal formulations have thermal conductivities exceeding even the thermal conductivities of the wrought 6061 aluminum up to 380 K. At approximately 275 K, the difference between these new powder metal compositions and the wrought 6061 material is markedly different, with the new powder metal compositions having thermal conductivities just under 220 W/m-K and the wrought 6061 aluminum having a thermal conductivity of approximately 190 W/m-K. As the temperature increases to 390 K, the thermal conductivities of the Al-1.5Mg-1.5Sn powder metal sample and the wrought 6061 aluminum alloy converge at approximately 240 W/m-K. Over this same temperature range, however, the Al-1.5Mg-1.5Sn-0.2Zr powder metal sample continues to have a thermal conductivity exceeding the wrought 6061 aluminum alloy, with the Al-1.5Mg-1.5Sn-0.2Zr powder metal sample approaching a thermal conductivity of 260 W/m-K at 390 K.

Figure 2:
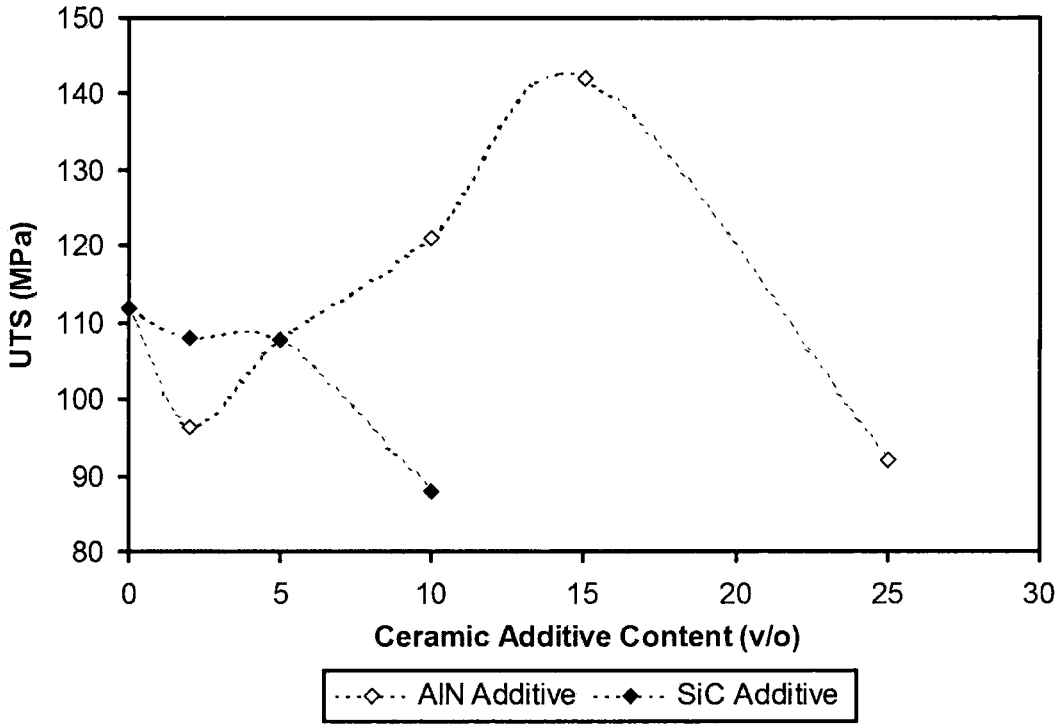
FIG. 2 is a graph showing the effect of various volume additions of AlN and SiC ceramic additives on the ultimate tensile strength in a part made from a Al-1.5Mg-1.5Sn powder metal.

Looking now at FIG. 2, the effect of AlN and SiC additives on the ultimate tensile strength are shown for the Al-1.5Mg-1.5Sn system. Most notably, the inclusion of AlN in the Al-1.5Mg-1.5Sn system will increase ultimate tensile strengths up to 15 volume percent (at which point, the ultimate tensile strength of the material is approximately 140 MPa). Any ceramic additions beyond this point will tend to degrade the ultimate tensile strength of the system.

Although it is not indicated in the data in FIGS. 1 and 2, the AlN additions have a relatively mild effect on the sinterability of these alloys. Further, the compaction pressure of the parts made from the Al-1.5Mg-1.5Sn and the Al-1.5Mg-1.5Sn-0.2Zr powder metals also do not significantly alter the sinterability of the powders.

Figure 3:
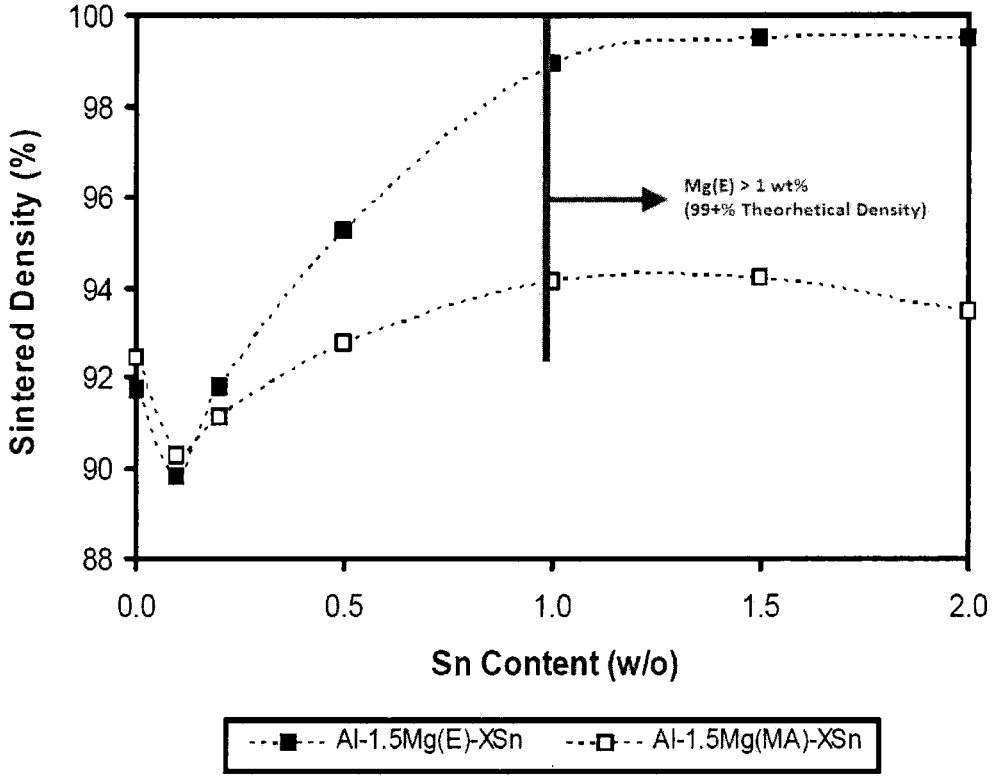
FIG. 3 is a graph illustrating and comparing the sintering response of Al-1.5Mg—XSn materials over a range of 0 to 2.0% elemental tin additions and with the magnesium additions as either elemental additions or master alloy additions.

Turning now to FIG. 3, the sintering response of elemental magnesium additions and master alloy magnesium additions are compared over a range of elemental tin additions from no tin to 2 wt % Sn. The data points marked "Al-1.5Mg(E)-XSn" are shown as black filled squares and denote elemental magnesium additions, while the data points marked "Al-1.5Mg(MA)-XSn" are shown as black squares with no fill and denote magnesium additions as part of a master alloy.

FIG. 3 illustrates that, for 1.5 wt % magnesium (either as an elemental addition or as a master alloy addition), there is little to no further improvement in sintered density as a percentage of theoretical density for elemental additions of tin past 1.0 wt %. As illustrated, with no tin additions, the sintered density is approximately 92% of theoretical density and then dips to approximately 90% of theoretical density with the addition of approximately 0.1 wt % tin. Further elemental additions between approximately 0.1 wt % tin and 1.0 wt % tin result in improvements to sintered density. For the parts made using elemental magnesium additions of 1.5 wt %, elemental additions of tin above 1.0 wt % and between 1.0 wt % and 2.0 wt % are shown to achieve greater than 99% of theoretical density. For parts made using master alloy magnesium additions of 1.5 wt %, the sintered density peaks at around 1 wt % elemental tin additions, at which point sintered density is approximately 94% of theoretical density, and further tin additions past 1.0 wt % do not improve the sintered density.

FIG. 3 clearly illustrates that magnesium and tin additions are synergistic with respect to densification, which in part is responsible for the high thermal conductivity observed in these powder systems. In particular, elemental tin and magnesium additions are shown to present exceptional sintered densities.

Figure 4:
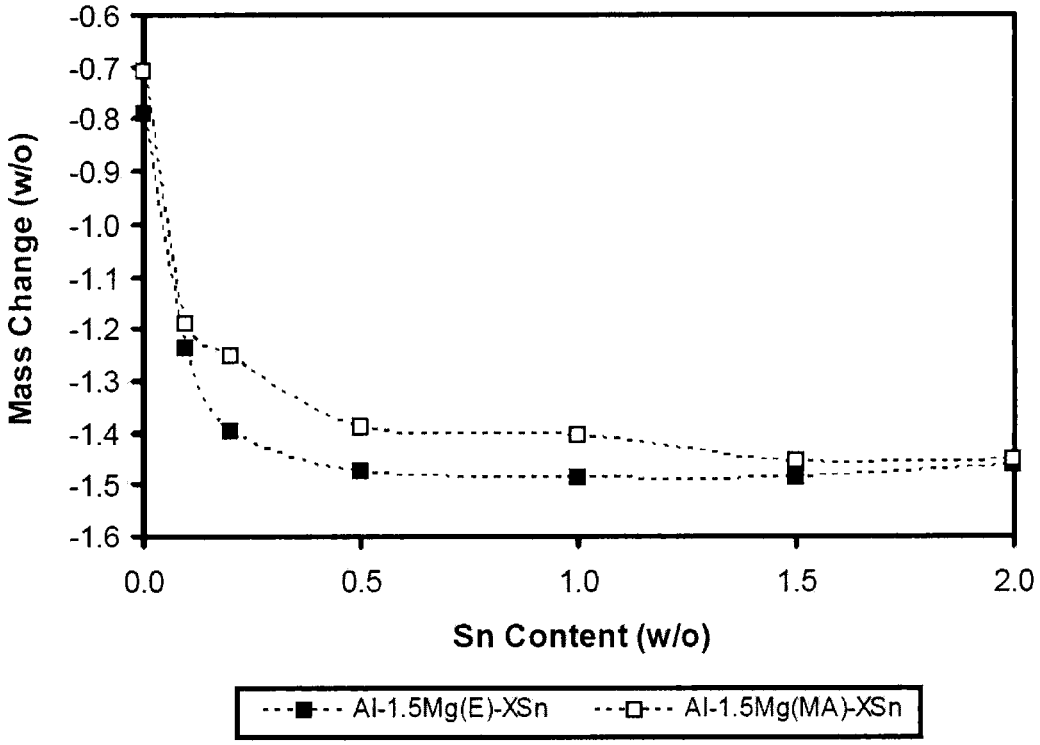
FIG. 4 is a graph illustrating the mass loss for the Al-1.5Mg—XSn materials from FIG. 3 over a similar range of elemental tin additions and for magnesium additions as either elemental additions or master alloy additions.

With further reference to FIG. 4, the percent mass change of sintered parts made using Al-1.5Mg(E)-XSn and Al-1.5Mg(MA)-XSn are illustrated over a range of elemental tin additions between no tin and 2.0 wt % tin. Again, as with FIG. 3, the black filled squares correspond to the 1.5 wt % elemental magnesium additions and the black squares without fill correspond to the 1.5 wt % master alloy magnesium additions.

FIG. 4 illustrates the effect of elemental tin additions on weight loss of the parts during sintering. For the parts, the maximum weight loss is approximately 1.5 wt %. This 1.5 wt % mass loss approximately corresponds to the full amount of Licowax in the compacted part, which is initially used to hold the compacted powder metal particles together. This Licowax is burnt off during the sintering process.

However, this full 1.5% mass loss can be offset by the formation of AlN under certain conditions. The formation of AlN adds mass to the sintered parts and is generally an undesirable phase to be formed in these high thermal conductivity parts. Notably, at lower weight percentages of elemental tin additions, there is less mass loss because AlN is more prone to form in the absence of tin additions. However, even relatively small tin additions suppress the in-situ formation of AlN and result in increased mass loss. This is illustrated by the plotted data in which, at no tin additions, the mass change or loss is only approximately 0.7 to 0.8 wt % due to the formation of AlN. However, by approximately 0.5 wt % tin, the mass change or loss has dropped to approximately 1.4 to 1.5 wt % and AlN formation is much less pronounced.

Figure 5:
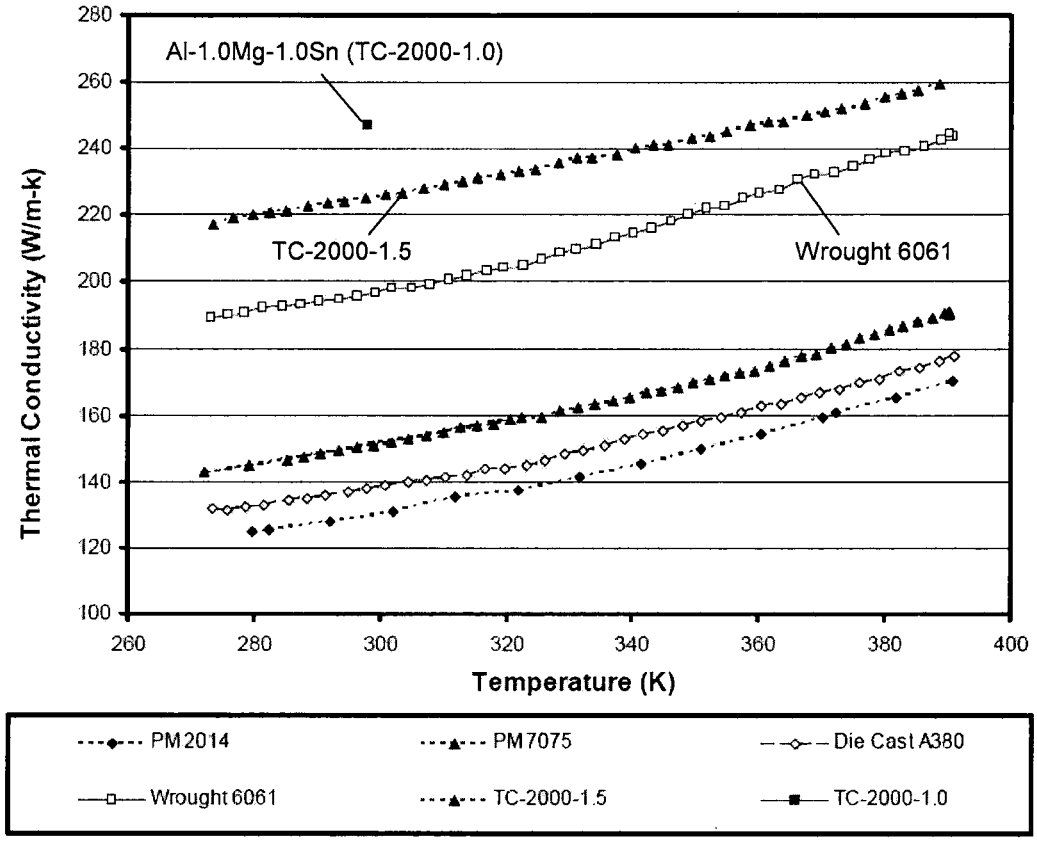
FIG. 5 is a graph comparing the thermal conductivities of parts made from various materials over a range of temperatures, including some of the materials from FIG. 1 as well as an Al-1.0Mg-1.0Sn material (TC2000-1.0).

Turning now to FIG. 5, a graph comparing the thermal conductivities of parts made from various materials over a range of temperatures is illustrated. These thermal conductivities include some of the materials from FIG. 1, as well as a sample of a Al-1.0Mg-1.0Sn material in which magnesium and tin are elemental additions.

Some slightly different nomenclature is used in FIG. 5 in comparison to FIG. 1. In FIG. 5, the material identified as PM2014 corresponds to the material Alumix 123 in FIG. 1. Also, in FIG. 5, the material TC-2000-1.5 corresponds to the material Al-1.5Mg-1.5Sn in FIG. 1.

In any event, FIG. 5 illustrates that the material Al-1.0Mg-1.0Sn (also identified herein as TC-2000-1.0, which has 1.0 magnesium and 1.0 tin additions) has even better thermal conductivity at approximately 300 K than the other materials and even better thermal conductivity that the Al-1.5Mg-1.5Sn material (i.e., TC-2000-1.5). Although other data points are not provided, it can be safely extrapolated that over the range of 270 K to 390 K, the thermal conductivity of the Al-1.0Mg-1.0Sn material will exceed the thermal conductivity of the wrought 6061 material as, thermal conductivities will generally improve as temperature increases and the thermal conductivity of the Al-1.0Mg-1.0Sn material at 300 K already exceeds the thermal conductivity of the wrought 6061 material at the high end of the temperature range (i.e. 390 K).

Table I below provides a listing of various thermal conductivities of aluminum materials:

TABLE I

| | | | Thermal | Mass or Specific Thermal Conductivity | |
|---|---|---|---|---|---|
| Material | Process/ Grade | Density ($g/cm^3$) | Conductivity (w/m-k) | TC/ Density | Normalized |
| Aluminum | Pure | 2.7 | 247 | 91 | 1 |
| Copper | Pure | 8.9 | 398 | 45 | 0.49 |
| Aluminum | PM ACT1-2014 | 2.6 | 144 | 55 | 0.60 |
| Aluminum | PM Al MMC1 | 2.7 | 137 | 51 | 0.56 |
| Aluminum | PM TC2000-1.5 | 2.7 | 210-230 | 81 | 0.89 |
| Aluminum | PM TC2000-1.0 | 2.7 | 240-250 | 90 | 0.99 |

Table I provides comparative data for thermal conductivity illustrating that the TC2000-1.0 material (i.e., the Al-1.0Mg-1.0Sn material) has thermal conductivities that are comparable to pure wrought aluminum. Moreover, comparing the ratios of thermal conductivity to density, it can be observed that the Al-1.0Mg-1.0Sn material has normalized ratios that approximate that of the pure wrought aluminum (i.e., the Al-1.0Mg-1.0Sn has a normalized thermal conductivity to density ratio of approximately 0.99 in comparison to pure aluminum). The TC2000-1.5 and TC2000-1.0 powder metal materials are also illustrated as having comparably better normalized thermal conductivity to density ratios than other powder metal materials such as the ACT1-2014 and Al MMC1 processes/grades.

Although data for Al-1.0Mg-1.0Sn and Al-1.5Mg-1.5Sn systems have been provided, it will again be appreciated that magnesium may fall within a range of 0.2 to 3.5 wt % and tin could fall within a range of 0.2 to 2.5 wt %. In some forms, magnesium content may be 0.2, 0.3, 0.4, 0.5, 0.6, 0.7, 0.8, 0.9. 1.0, 1.1, 1.2, 1.3, 1.4, 1.5, 1.6, 1.7, 1.8, 1.9. 2.0, 2.1, 2.2, 2.3, 2.4, 2.5, 2.6, 2.7, 2.8, 2.9. 3.0, 3.1, 3.2, 3.3, 3.4, or 3.5 wt %. In some forms, tin may be 0.2, 0.3, 0.4, 0.5, 0.6, 0.7, 0.8, 0.9. 1.0, 1.1, 1.2, 1.3, 1.4, 1.5, 1.6, 1.7, 1.8, 1.9. 2.0, 2.1, 2.2, 2.3, 2.4, or 2.5 wt %.

Thus, new aluminum alloy powder metal formulations are disclosed that have higher thermal conductivity than traditional aluminum alloy powder metal materials. These new powder metals could be used to form sintered parts such as heat sink, which would benefit from the improved thermal conductivity of the parts and, moreover, because of their high production volumes would be good candidates for fabrication by powder metallurgy.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A sintered powder metal heat sink consisting of an aluminum alloy powder metal compacted and sintered to form the sintered powder metal heat sink, the aluminum alloy powder metal including a nominally pure aluminum material with magnesium and tin additions and optionally a zirconium addition wherein, in a temperature range of 280K and 320K, the sintered powder metal heat sink has a thermal conductivity above 217 W/m-K.

2. A sintered powder metal heat sink consisting of an aluminum alloy powder metal compacted and sintered to form the sintered powder metal heat sink, the aluminum alloy powder metal including:

magnesium in a range of 0.2 to 3.5 wt %;

tin in a range of 0.2 to 2.5 wt %; and optionally zirconium in a range of 0.1 to 1.0 wt %;

wherein a remainder of the aluminum alloy powder metal is nominally pure aluminum and further wherein, in a temperature range of 280K and 320K, the sintered powder metal heat sink has a thermal conductivity above 217 W/m-K.

3. A sintered powder metal heat sink consisting of an aluminum alloy powder metal compacted and sintered to form the sintered powder metal heat sink, the aluminum alloy powder metal including a nominally pure aluminum material with magnesium and tin additions and optionally a zirconium addition wherein, in a temperature range of 280K and 320K, the sintered powder metal heat sink has a thermal conductivity between 217 W/m-K and 233 W/m-K.

4. The sintered powder metal heat sink of claim 3, wherein the magnesium addition is made as an admixed powder and the tin is added as an elemental powder or pre-alloyed with the aluminum material.

5. The sintered powder metal heat sink of claim 4, wherein the magnesium is approximately 1.5 weight percent of the aluminum alloy powder metal and the tin is approximately 1.5 weight percent of the aluminum alloy powder metal.

6. The sintered powder metal heat sink of claim 4, wherein the magnesium is approximately 1.0 weight percent of the aluminum alloy powder metal and the tin is approximately 1.0 weight percent of the aluminum alloy powder metal.

7. The sintered powder metal heat sink of claim 4, wherein the aluminum alloy powder metal further comprises the zirconium addition.

8. The sintered powder metal heat sink of claim 7, wherein the zirconium addition is in a range of 0.1 weight percent to 1.0 weight percent.

9. The sintered powder metal heat sink of claim 8, wherein the zirconium addition is approximately 0.2 weight percent.

10. The sintered powder metal heat sink of claim 7, wherein the zirconium addition is homogenously dispersed throughout the aluminum material by gas atomizing the zirconium addition in the aluminum material.

11. The sintered powder metal heat sink of claim 3, wherein the magnesium is in a range of 0.2 to 3.5 wt % and tin is in a range of 0.2 to 2.5 wt %.

12. A sintered powder metal heat sink consisting of an aluminum alloy powder metal compacted and sintered to form the sintered powder metal heat sink, the aluminum alloy powder metal including:

magnesium in a range of 0.2 to 3.5 wt %;

tin in a range of 0.2 to 2.5 wt %; and optionally zirconium in a range of 0.1 to 1.0 wt %;

wherein a remainder of the aluminum alloy powder metal is nominally pure aluminum and further wherein, in a temperature range of 280K and 320K, the sintered powder metal heat sink has a thermal conductivity between 217 W/m-K and 233 W/m-K.

13. The sintered powder metal heat sink of claim 12, wherein the magnesium is approximately 1.0 weight percent of the aluminum alloy powder metal and the tin is approximately 1.0 weight percent of the aluminum alloy powder metal.

* * * * *